US006690300B1

(12) United States Patent
Gaskins

(10) Patent No.: US 6,690,300 B1
(45) Date of Patent: Feb. 10, 2004

(54) MARINE ENGINE THROTTLE CONTROL METHOD FOR SINGLE OR TWIN ENGINE APPLICATIONS

(75) Inventor: Ronald Eugene Gaskins, Kokomo, IN (US)

(73) Assignee: Delphi Technologies, Inc., Troy, MI (US)

( * ) Notice: Subject to any disclaimer, the term of this patent is extended or adjusted under 35 U.S.C. 154(b) by 541 days.

(21) Appl. No.: 09/686,796

(22) Filed: Oct. 11, 2000

(51) Int. Cl.[7] ..... G08B 23/00

(52) U.S. Cl. ..... 340/984; 340/969; 340/815.4; 441/1; 441/2; 60/221

(58) Field of Search ..... 340/984, 969, 340/456; 701/21, 39; 123/328, 337, 339.1, 339.13, 349, 351, 352, 361, 376, 406.52; 440/1, 2, 87

(56) References Cited

U.S. PATENT DOCUMENTS 4,227,428 A * 10/1980 Zifferer et al. ..... 74/526
4,479,357 A * 10/1984 Stewart ..... 60/719
4,836,809 A * 6/1989 Pelligrino ..... 440/2
4,850,318 A * 7/1989 Torigai et al. ..... 123/352
4,853,673 A * 8/1989 Kido et al. ..... 340/439
6,116,971 A * 9/2000 Morikami ..... 440/2

* cited by examiner

*Primary Examiner*—Daniel J. Wu
*Assistant Examiner*—Son Tang

(74) *Attorney, Agent, or Firm*—Jimmy L. Funke; Stefan V. Chmielewski

(57) ABSTRACT

An improved marine engine control methodology is utilized in either single or twin engine applications, and provides a safe and logical transitioning between manual and automatic operating modes. A standard software instruction set is installed in a microprocessor-based engine control module for each engine, and a discrete input informs the control module if the respective engine is a master engine or a slave engine. In single engine applications, the engine is identified as a master engine, while in twin engine applications, one of the engines is identified as a master engine, and the other as a slave engine. The control software provides an operator activated speed control function for a master engine, and an operator activated sync control function for a slave engine. Each engine has an operator manipulated throttle lever for controlling the respective engine throttle position during the manual operating mode, and for defining a limit throttle position during the automatic operating modes. Transitioning from automatic to manual operating modes occurs when the limit throttle position prevents the automatic control from achieving or maintaining the desired engine speed. A simple panel indicator is provided for each engine, and is activated in a steady mode to indicate complete engagement of the respective automatic mode, and in a pulsed mode to inform the operator that the respective throttle lever is limiting the automatic mode. When the respective throttle lever is sufficiently reduced, the control transitions from automatic mode to manual mode and the respective panel lamp is deactivated.

6 Claims, 3 Drawing Sheets

MARINE ENGINE THROTTLE CONTROL METHOD FOR SINGLE OR TWIN ENGINE APPLICATIONS

TECHNICAL FIELD

The present invention is directed to an engine throttle control method for marine applications involving either one or two engines.

BACKGROUND OF THE INVENTION

There is a desire in the marine industry to utilize engine throttle controls to achieve various automatic operating modes. Such modes include a cruise mode in which the engine throttle is regulated to maintain a selected engine cruising speed, and a sync mode in which a pair of engines are maintained in speed synchronism. Various approaches have been taken for achieving these and other controls, and the control software tends to be very application specific, resulting in a number of different operator interfaces that vary in complexity and ease of use. Additionally, there has been no standard approach for transitioning between automatic and manual operating modes, which can result in unexpected power surging and erratic operation.

SUMMARY OF THE INVENTION

The present invention is directed to an improved marine engine throttle control methodology that can be utilized in either single or twin engine applications, and that provides a safe and logical transitioning between manual and automatic operating modes. According to this invention, a standard software instruction set is installed in a microprocessor-based engine control module for each engine, and a discrete input informs the control module if the respective engine is a master engine or a slave engine. In single engine applications, the engine is identified as a master engine, while in twin engine applications, one of the engines is identified as a master engine, and the other as a slave engine. The control software provides an operator activated speed control function for a master engine, and an operator activated sync control function for a slave engine. Each engine has an operator manipulated throttle lever for controlling the respective engine throttle position during the manual operating mode, and for defining a limit throttle position during the automatic operating modes. Transitioning from automatic to manual operating modes occurs when the limit throttle position prevents the automatic control from achieving or maintaining the desired engine speed. A simple panel indicator is provided for each engine, and is activated in a steady mode to indicate complete engagement of the respective automatic mode, and in a pulsed mode to inform the operator that the respective throttle lever is limiting the automatic mode. When the respective throttle lever is sufficiently reduced, the control transitions from automatic mode to manual mode and the respective panel lamp is deactivated.

DESCRIPTION OF THE PREFERRED EMBODIMENT

Figure 1A:
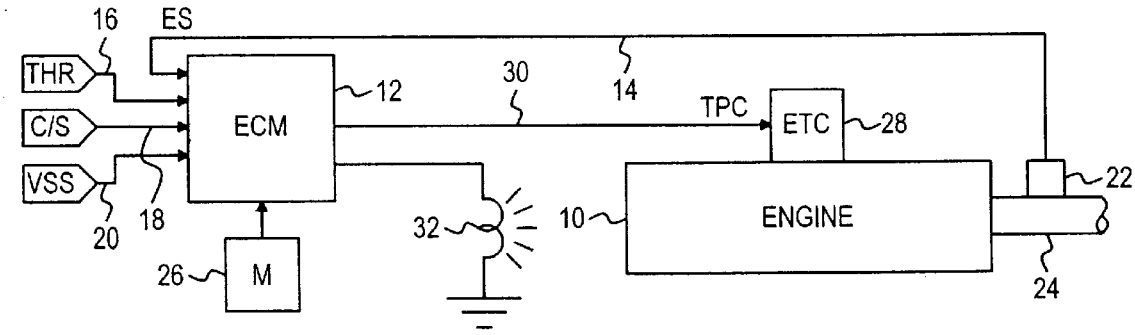
FIGS. 1A and 1B respectively depict single engine and twin engine marine powertrains according to this invention, each engine having a microprocessor-based engine control module.
Figure 1B:
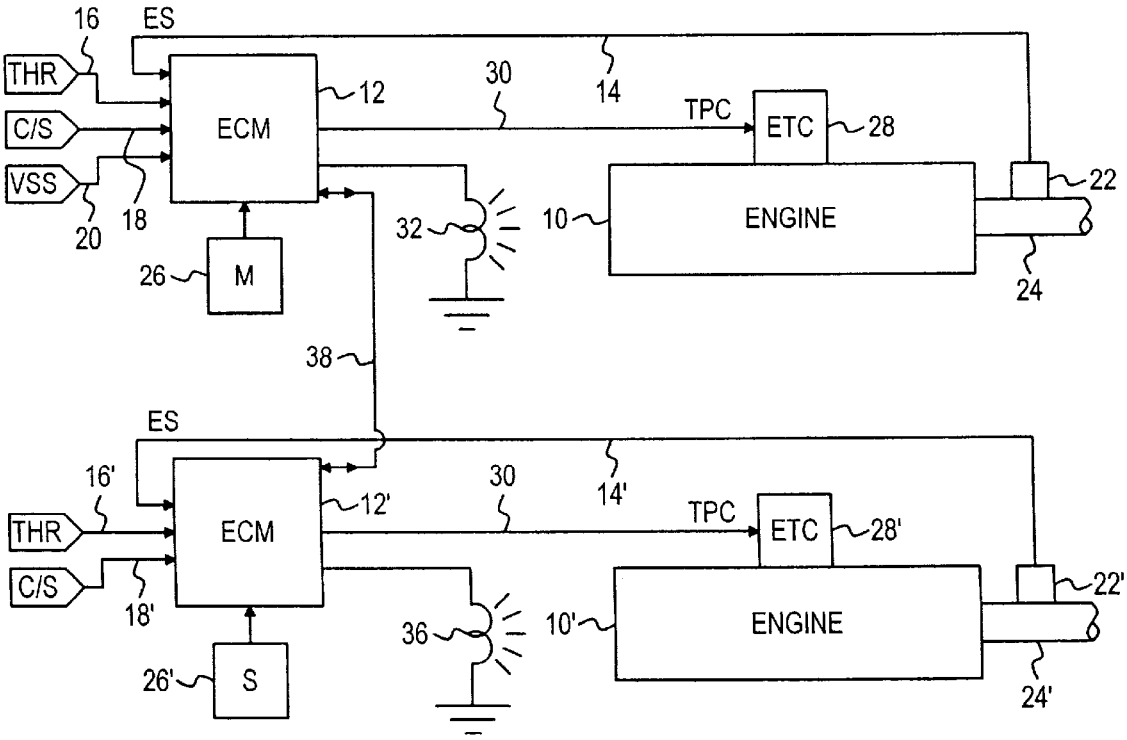

As indicated above, FIGS. 1A and 1B respectively depict single engine and twin engine marine powertrains configured according to this invention. As explained below, a separate engine control module (ECM) is provided for each engine of the powertrain, and this invention is specifically directed to a control method that is carried out independently by each such ECM.

Referring to FIG. 1A, the single engine powertrain comprises the engine 10 and engine control module (ECM) 12. The ECM 12 is responsive to a number of inputs including an engine speed signal ES on line 14, an operator adjusted throttle signal (THR) on line 16, a cruise/sync switch (C/S) on line 18, and a variable speed (VSS) input on line 20. The engine speed signal ES is developed by a conventional speed transducer 22 responsive to rotation of the engine output shaft 24. The throttle signal THR represents the position of a manually positioned throttle lever, and also defines an upper throttle position limit for the automatic control modes, as explained below. Additionally, the ECM 12 receives a discrete input 26 (which may be in the form of a dip switch or wiring harness, for example) indicating that the engine 10 is to be operated as a master (M) engine. In the illustrated embodiment, the cruise/sync switch (C/S) is a normally off momentary switch for operator activation of an engine speed control function that maintains a current speed condition. When, as in FIG. 1A, the discrete input 26 indicates that the ECM 12 is controlling a master (M) engine, the C/S switch is regarded as a cruise switch for controlling operator activation of a cruise function that automatically maintains a current speed of engine 10, within the throttle limit imposed by the throttle signal THR. Finally, the variable speed input VSS is a digital or analog signal representing the set speed of an operator adjusted engine speed request device.

In the illustrated embodiment, the engine 10 is equipped with an electronic throttle control module (ETC) 28, and the ECM 12 supplies a throttle position command TPC signal to module 28 via line 30 based on the above-mentioned inputs. Ordinarily, the TPC signal is developed in accordance with the throttle signal THR on line 16, but when an automatic speed control mode (cruise or variable speed) is engaged, the ECM 12 has the authority to set TPC to a value lower than THR in order to maintain the engine speed ES at a desired value. The desired value may be determined by depressing the cruise/sync switch, or by the variable speed input VSS, which embodies an analog or digital speed command as mentioned above. Additionally, the ECM controls the activation of an instrument panel lamp 32, occasionally referred to herein as the speed control (i.e., cruise or variable speed) status lamp.

Referring to FIG. 1B, the twin engine powertrain includes the same components shown in the single engine powertrain of FIG. 1A, plus a second engine and a second ECM. The components common to FIGS. 1A and 1B are identified by the same reference numerals, whereas the corresponding additional components in FIG. 1B are identified by corresponding primed reference numerals. Thus, the twin engine application additionally includes a second engine 10' having an output shaft 24', an speed sensor 22', and an ETC module 28'; and an ECM 12' having a THR input 16', an ES input on line 14', a cruise/sync C/S input on line 18', and a discrete input 26'. In the case of second ECM 12', the discrete input 26' identifies the second engine 10' as a slave (S) engine, and the cruise/sync switch C/S is regarded as a sync switch for controlling operator activation of a sync function that automatically maintains engine 10' in speed synchronism with master engine 10, within the throttle limit imposed by the throttle signal THR on line 16'. In sync control, the speed of the master engine 10 may be obtained by direct measurement, or via a bus 38 coupling ECM 12 and ECM 12'. Since a slave engine has no independent speed control function, the instrument panel lamp 36 controlled by ECM 12' is occasionally referred to herein as a sync status lamp.

It will be recognized, of course, that the automatic control functions described above will not be present in every marine installation. And some installations may have only one or two of the automatic control functions. However, according to this invention, the same control software may be used in any installation regardless of the provided automatic control functionality level. This is conveniently achieved through the use of ECM calibration bits set by system installer. For example, a first calibration bit is used to enable/disable the cruise/sync function, and a second calibration bit is used to enable/disable the variable speed control function. If the calibration bits enable a particular control function, the ECM 12, 12' reads the respective input C/S, VSS, and carries out the enabled control. If the calibration bits disable a particular control function, the ECM 12, 12' ignores the respective input C/S, VSS, and controls the engine throttle in accordance with the throttle signal THR.

Figure 2:
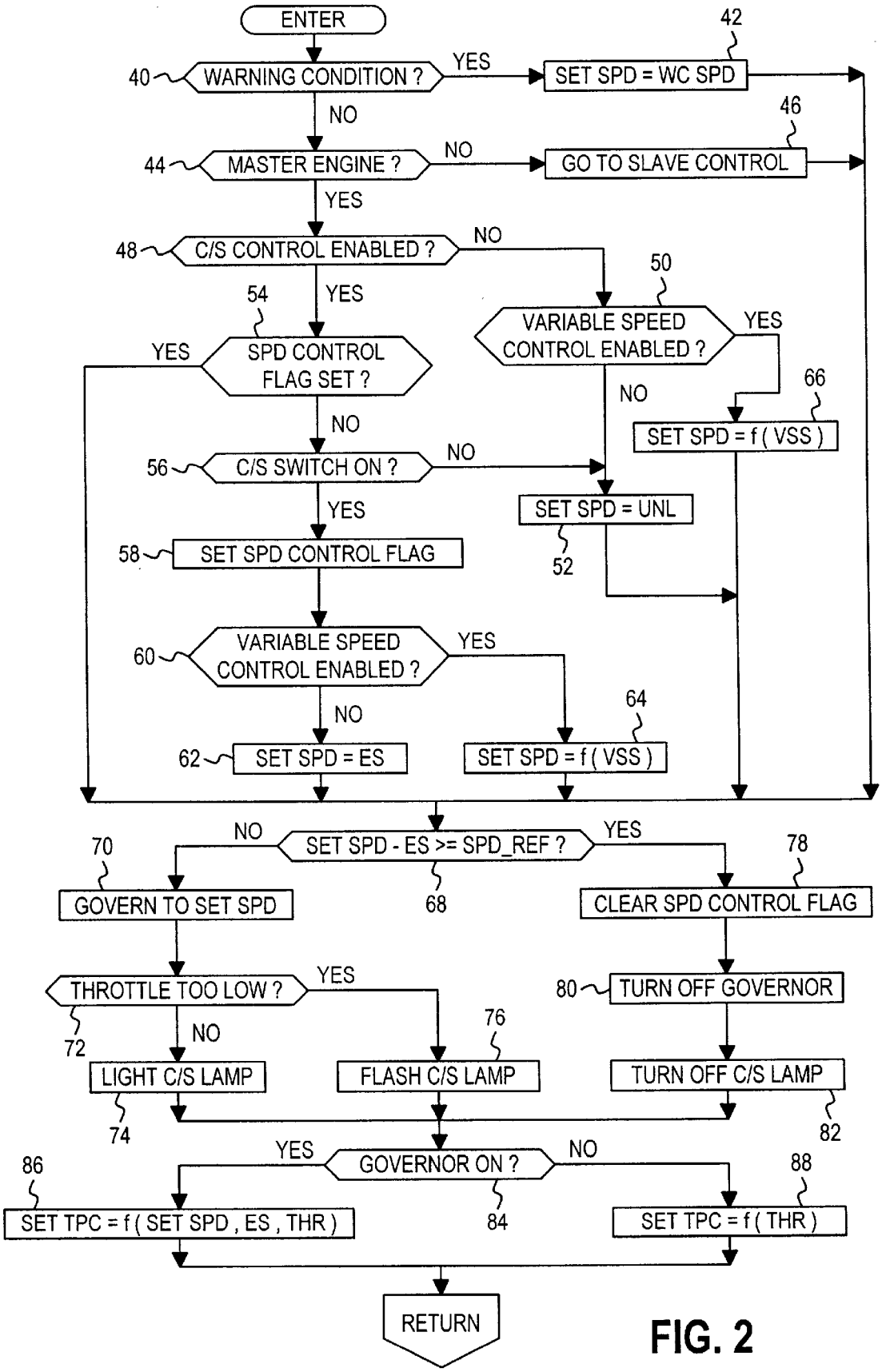
FIGS. 2 and 3 depicts a flow diagram representative of computer program instructions executed by the engine control modules of FIGS. 1A and 1B for carrying out the control of this invention.
Figure 3:
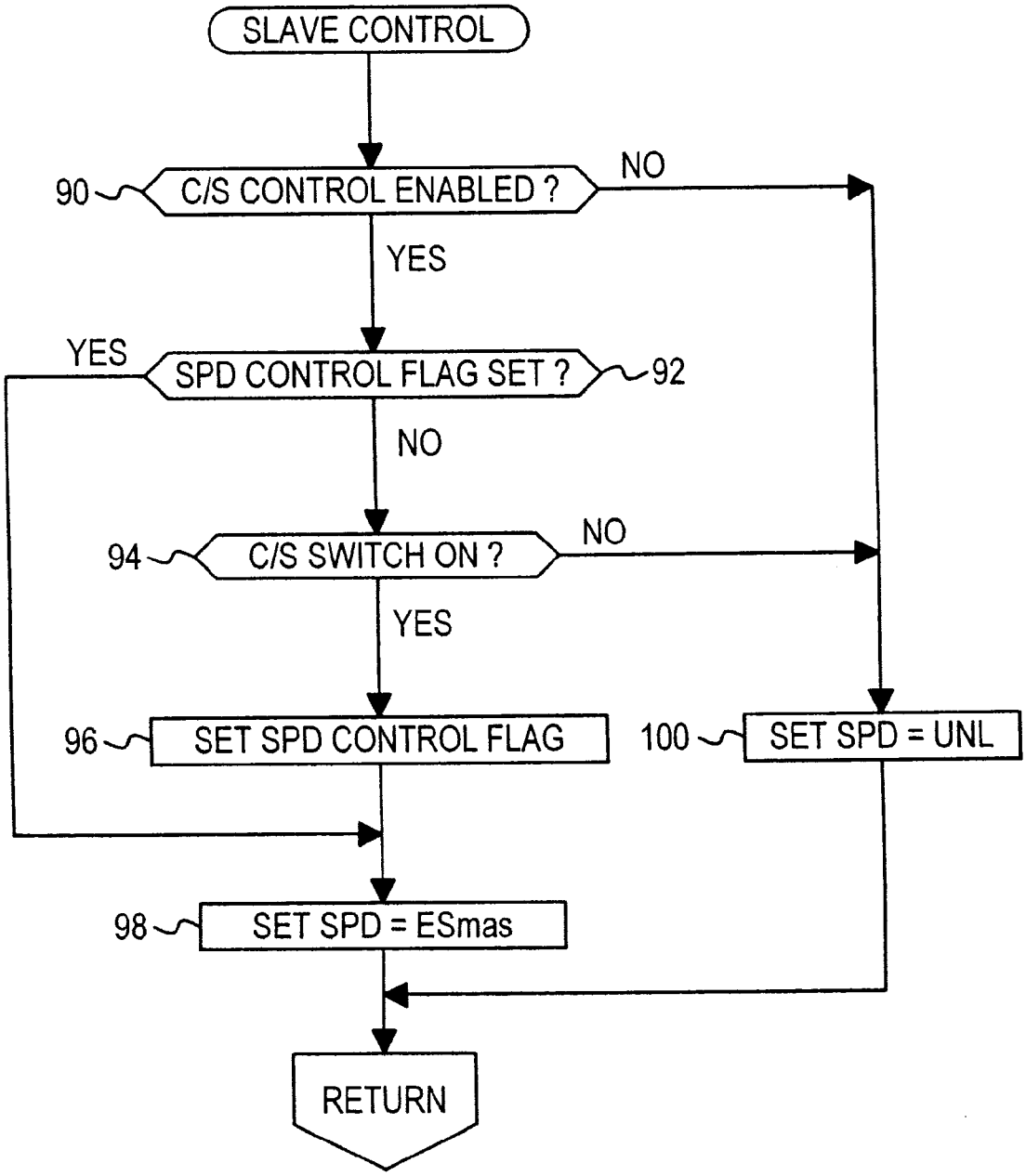

The control carried out according to this invention is represented by the flow diagrams of FIGS. 2 and 3. In the single engine application of FIG. 1A, the control software is executed by the single ECM 12; in the twin engine application of FIG. 1B, the control software is executed by both ECM 12 and ECM 12'. In general, the flow diagram of FIG. 2 illustrates the master-specific and common control functions, whereas the flow diagram of FIG. 3 illustrates the slave-specific control functions.

Referring to FIG. 2, the blocks 40–42 are first executed to determine if a warning condition is present, and if so, to set the variable SET SPD equal to an appropriate warning condition (WC) speed. The warning conditions may include, for example, engine over-temperature, low oil pressure, low oil level, etc., and the system installer may calibrate corresponding WC speeds. If a warning condition is not present, the block 44 checks the discrete input 26, 26' to determine if the controlled engine is a master engine. If so, the blocks 48–66 of FIG. 2 are executed; if not, the flow diagram of FIG. 3 is executed, as indicated at block 46. In either case, the blocks 68–88 of FIG. 2 are then executed to determine the appropriate throttle position command TPC.

In the case of a master engine, block 44 of FIG. 2 will be answered in the affirmative, and the blocks 48 and 50 are executed to determine if the cruise and/or variable speed functions are enabled, as determined by the corresponding calibration bits. If neither function is enabled, block 52 makes the variable SET SPD equal to UNL, indicating that the automatic speed setting is unlimited. If the variable speed function is enabled, but the cruise function is not enabled, the block 66 sets SET SPD equal to the variable speed input VSS. If the cruise function is enabled, and block 54 determines that the SPD CONTROL flag is not set (indicating that speed control is not currently engaged), the block 56 is executed to determine if the C/S switch is on. If not, block 52 sets SET SPD to UNL as explained above; if so, blocks 58–66 are executed. Block 58 sets the SPD CONTROL flag, blocks 60 and 62 make SET SPD equal to engine speed ES if the variable speed function is not also enabled, and blocks 60 and 64 make SET SPD equal to the variable speed input VSS if the variable speed function is also enabled. Thus, the variable speed function takes precedence when both the cruise function and the variable speed function are enabled. Once the SPD CONTROL flag is set, block 54 is answered in the affirmative, so that the blocks 52, 56, 58, 60, 62, 64 are skipped, as indicated.

In the case of a slave engine, block 44 of FIG. 2 will be answered in the negative, and the block 90 of FIG. 3 is executed to determine if the sync function is enabled. If not, the block 100 sets the variable SET SPD equal to UNL, indicating that the automatic speed setting is unlimited. If the sync function is enabled, and block 92 determines that the SPD CONTROL flag is not set (indicating that speed control is not currently engaged), the block 94 is executed to determine if the C/S switch is on. If not, block 100 sets SET SPD to UNL as explained above; if so, blocks 96 and 98 are executed to set the SPD CONTROL flag and to make SET SPD equal to the current speed ESmas of the master engine 10. Once the SPD CONTROL flag is set, block 92 is answered in the affirmative, so that the blocks 94, 96 and 100 are skipped, as indicated.

Once the master-specific or slave-specific instructions have been executed, the blocks 68–88 of FIG. 2 are executed to determine the appropriate throttle position command TPC. Referring to FIG. 2, the block 68 is first executed to determine if SET SPD exceeds the current engine speed ES by at least a reference speed SPD_REF that preferably is scheduled as a function (a percentage, for example) of the current engine speed ES. This condition can occur if SET SPD has been set to UNL (that is, automatic speed control is not engaged), or if the respective throttle lever has been reduced to the point where the automatic control is clearly unable to maintain the engine speed ES at SET SPD. Thus, if block 68 is answered in the affirmative, the blocks 78, 80 and 82 are executed to clear the SPD CONTROL flag, to turn off the engine governor function (which may involve setting or clearing a flag, for example), and to turn off the respective panel lamp 32, 36. On the other hand, if block 68 is answered in the negative, automatic speed control is engaged, and the blocks 70–76 are executed. The block 70 turns on the governor function, the blocks 72 and 74 turn on the respective panel lamp 32, 36 in a steady mode if the throttle lever setting THR is sufficiently high to allow accurate speed control, and the blocks 72 and 76 light the respective panel lamp 32, 36 in a pulse or flashing mode if the throttle lever setting is too low (that is, if THR is less than the engine throttle setting required for automatic speed control). Finally, block 84 is executed to check the status of the governor function. If the governor function is turned off, the block 88 sets the throttle position command TPC as a function of THR alone. If the governor function is turned on, block 86 sets the throttle position command TPC as a function of SET SPD, ES and THR; the difference (SET SPD—ES) is used as an error signal for determining a required throttle position, and THR defines an upper limit value for the throttle position command TPC.

In summary, this invention provides a marine engine control methodology that can be utilized in either single or twin engine applications, and that provides a safe and logical transitioning between manual and automatic operating modes with a simple and intuitive operator interface.

With a master engine (single or twin engine applications) configured for cruise and/or variable speed control, the operator engages automatic speed control by depressing the cruise/sync (C/S) switch or suitably adjusting the variable speed input (VSS). The automatic control adjusts the engine throttle to maintain or achieve the desired speed, but does not adjust the engine throttle position beyond a limit position corresponding to the position of the engine throttle lever. If the desired speed is achieved, the panel lamp is turned on in a steady mode, indicating that the automatic speed control is engaged and has sufficient authority to achieve the desired speed. On the other hand, if the desired speed cannot be maintained or achieved with the current throttle lever setting, the panel lamp is turned on in a pulsed (flashing) mode to indicate that the throttle lever setting must be increased if the desired speed (cruise or variable) is to be achieved. The automatic cruise or variable speed control is disengaged by reducing the throttle lever setting to a point where the automatic control can clearly no longer maintain the desired speed, and at such point, the panel lamp is turned off to indicate that manual control has been re-established. A similar control occurs for a slave engine configured for sync control, with the operator engaging automatic sync control by depressing the cruise/sync (C/S) switch. In this case, the automatic control adjusts the engine throttle to maintain or achieve speed synchronism with the master engine, but again, does not adjust the engine throttle position beyond a limit position corresponding to the position of the engine throttle lever. If speed synchronization is achieved, the panel lamp is turned on in a steady mode, indicating that the automatic control is engaged and has sufficient authority to synchronize the master and slave engines. On the other hand, if synchronization cannot be maintained or achieved with the current throttle lever setting, the panel light is turned on in a pulsed (flashing) mode to indicate that the throttle lever setting must be increased if speed synchronization is to be achieved. When sync control is no longer desired, the operator reduces the throttle lever setting to a point where the automatic control can clearly no longer maintain speed synchronism, and at such point, the panel lamp is turned off to indicate that manual control of the slave engine has been re-established.

While the present invention has been described in reference to the illustrated embodiments, it is expected that various modifications in addition to those mentioned above will occur to those skilled in the art. For example, the (C/S) switch may be configured as an on/off toggle switch instead of a momentary switch. In that case, the SPD CONTROL flag is only cleared (i.e., at block 78 of FIG. 2) if the C/S switch is turned off; if the C/S switch remains on, automatic control may be disengaged by sufficiently lowering the throttle lever setting, and then automatically resumed by sufficiently raising the throttle lever setting. Obviously, other variations are also possible. Accordingly, it will be understood that control methods incorporating these and other modifications may fall within the scope of this invention, which is defined by the appended claims.

What is claimed is:

1. A method for controlling a throttle setting of a first marine engine in accordance with an operator adjusted throttle signal and an operator activated switch input, comprising the steps of:

normally controlling said throttle setting in accordance with the operator adjusted throttle signal;

overriding the normal control of said throttle setting in response to operator activation of said switch input by determining an engine throttle setting for bringing a speed of the engine into correspondence with a set speed, and controlling the engine throttle setting in accordance with the determined engine throttle setting but not exceeding a throttle setting limit corresponding to the operator adjusted throttle signal;

activating an indicator to indicate that the operator adjusted throttle signal should be increased during said overriding of the normal control if said determined engine throttle setting exceeds said throttle setting limit; and returning to the normal control of said throttle setting when the speed of said first engine falls below said set speed by more than a specified amount.

2. The method of claim 1, including the steps of:

steadily activating said indicator during said overriding of the normal control;

pulsing said indicator on and off to indicate that the operator adjusted throttle signal should be increased if said determined engine throttle setting exceeds said throttle setting limit; and turning said indicator off during said normal control.

3. The method of claim 1, where said first engine is operated with a second engine, and the method includes the steps of:

designating one of said first and second engines as a slave engine, and the other of said first and second engines as a master engine;

initializing said set speed according to the engine speed in effect at operator activation of said switch input if said first engine is designated as a master engine; and initializing said set speed according to a speed of said second engine if said first engine is designated as a slave engine.

4. The method of claim 1, where said first engine is operated with a second engine, and the method includes the steps of:

designating one of said first and second engines as a slave engine, and the other of said first and second engines as a master engine; and if said first engine is designated as a master engine and an operator adjusted variable speed control is enabled for said first engine, overriding said normal control in response to receipt of said operator adjusted variable speed input.

5. The method of claim 4, including the step of:

initializing said set speed according to said operator adjusted variable speed input upon overriding said normal control.

6. The method of claim 1, wherein said specified amount is determined as a function of the speed of said first engine.

* * * * *